US005386647A

United States Patent [19]

Bauer et al.

[11] Patent Number: 5,386,647

[45] Date of Patent: Feb. 7, 1995

[54] THIN, SELF-CLEANING GAS DISTRIBUTION DECK IN FLUIDIZED BED DRYER

[75] Inventors: Robert G. Bauer, Gillette, Wyo.; Michael W. Shackelford, Carmel, Ind.; Mark H. Berggren, Golden, Colo.

[73] Assignee: Amax Coal West, Inc., Gillette, Wyo.

[21] Appl. No.: 123,814

[22] Filed: Sep. 20, 1993

Related U.S. Application Data

[63] Continuation of Ser. No. 21,346, Feb. 23, 1993, abandoned, and a continuation of Ser. No. 678,191, Apr. 1, 1991, abandoned.

[51] Int. Cl.[6] ..... F26B 17/00

[52] U.S. Cl. ..... 34/582; 34/583; 34/576; 422/143

[58] Field of Search ..... 34/359, 360, 364, 370, 34/576, 579, 582, 583, 585, 589; 110/245, 347, 263; 122/4 D; 432/58; 165/104.16; 422/143

[56] References Cited

U.S. PATENT DOCUMENTS

| | | | |
|---|---|---|---|
| 2,666,269 | 1/1954 | Parry | 34/10 |
| 3,546,787 | 8/1968 | Horner et al. | 34/57 A |
| 4,226,830 | 10/1980 | Davis | 34/57 A |
| 4,939,850 | 7/1990 | Baillie | 34/57 A |

*Primary Examiner*—Denise L. Gromada
*Attorney, Agent, or Firm*—Sheridan Ross & McIntosh

[57] ABSTRACT

A fluid bed reactor is provided with a loosely mounted, flexible multiperforate gas distributor plate so that in use the interaction of the flow of fluidizing gas, the plate and fluidized solids causes the plate to be flexed thereby cleaning the plate.

9 Claims, 4 Drawing Sheets

THIN, SELF-CLEANING GAS DISTRIBUTION DECK IN FLUIDIZED BED DRYER

This is a continuation of copending application Ser. No. 678,191, filed Apr. 1, 1991 now abandoned.

The present invention relates to fluid bed reactor and, more particularly, to fluid bed reactors for drying coal. This is a continuation of co-pending application Ser. No. 08/021,346, filed on Feb. 23, 1993, now abandoned.

BACKGROUND OF THE INVENTION since the early 1970's when the vulnerability of the United States on foreign energy sources became apparent, greater emphasis has been placed on exploiting our vast coal deposits. Many coal deposits in the West were developed because these deposits could be mined by highly efficient surface mining techniques and because the low sulfur content of these deposits were well suited to meet increasingly stringent environmental demands. Western coal, however, can contain 30% or more moisture which moisture significantly lowers Btu value of these coals and drastically limits their geographic markets.

Over the years many processes have been developed to dry coals, including thermal drying in fluid bed reactors. Fluid bed drying offers many advantages including highly efficient energy and mass transfer and high throughput rates. One problem encountered in the use of fluid bed reactors for coal drying has been the lack of control the fluidization process caused by the non-uniformity of the feed material. Conventional gas distributors consisting of concentric rings or grates of T-bars or other structural shapes, as disclosed in Chemical Engineers' Handbook, Fifth Edition, Editors Perry and Chilton, McGraw-Hill Book Company, New York, 1973, pp. 20–66 to 20–67, permit uneven gas flow and can cause channelling. Gas distributors comprising rigidly mounted perforated metal plates provide more uniform gas distribution but experience clogging by the fluidized solids.

SUMMARY OF THE INVENTION

Broadly stated, the present invention relates to a fluid bed reactor having an improved fluidizing distributor. The reactor comprises a shell defining an enclosed reactor space, a horizontally supported gas distributor plate separating the reactor space into a lower plenum chamber and an upper chamber for retaining solids immediately above the distributor plate and for providing a disengaging space above the fluidized solids. The fluid bed reactor is provided with means for introducing solids into the reactor at one or more locations above the distributor plate, means for discharging solids above the distributor plate, means for introducing fluidizing gas into the plenum chamber and means for discharging fluidizing gas and suspended above the fluidized solids.

The improved gas distributor comprises a plate having multiple perforations with the thickness of the plate and the openings of said perforations being correlated so that upon being flexed the plate becomes self-cleaning and the flow of fluidizing gas remains uniform. The plate is loosely mounted in the reactor so that the interaction of the flow of the fluidizing gas, the plate and the fluidized solid causes the plate to be flexed.

The improved gas distributor in accordance with the present invention is advantageously used in fluid bed reactors for both drying and cooling dried coal and other applications.

DETAILED DESCRIPTION OF THE INVENTION

Figure 1:
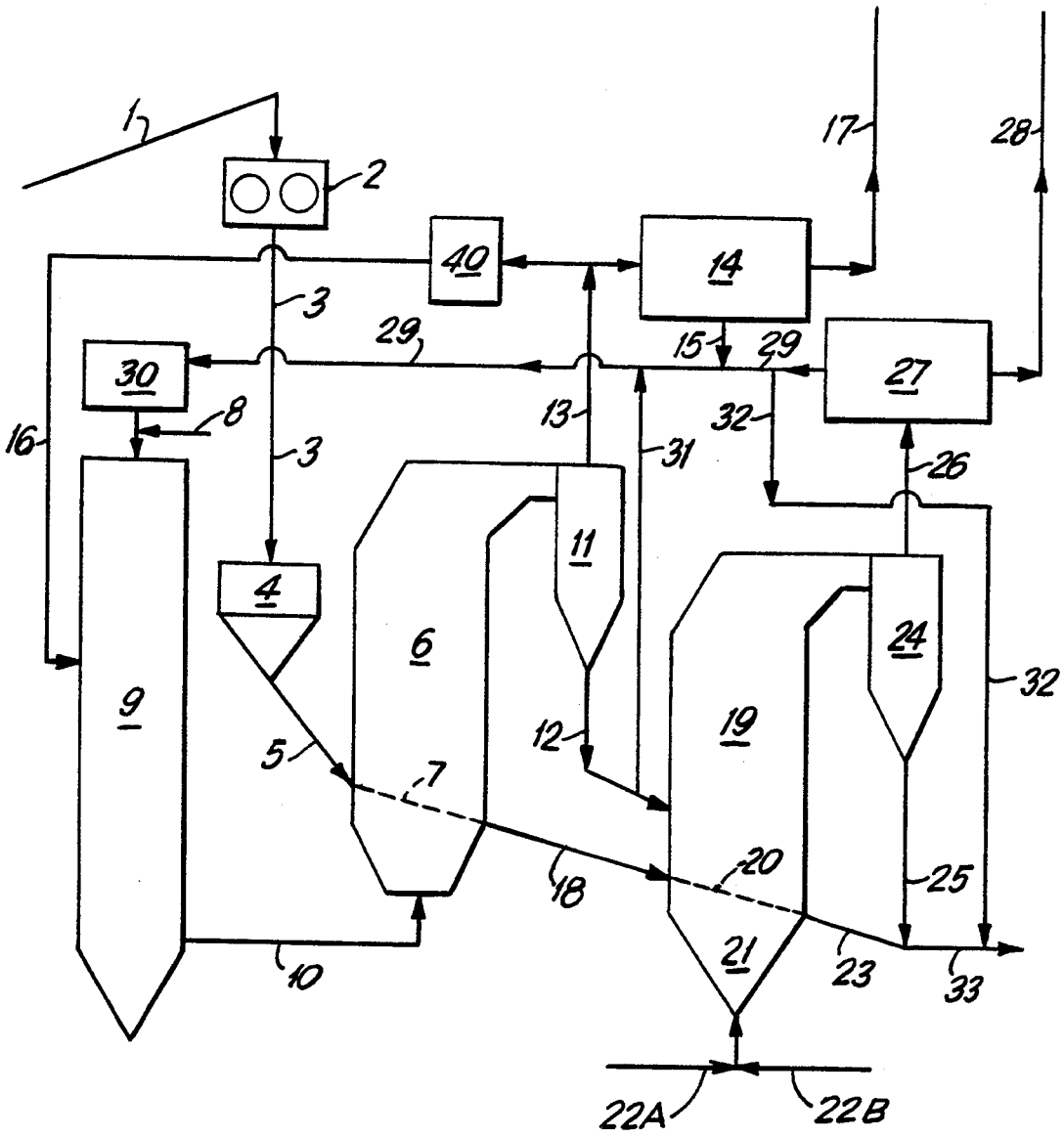
FIG. 1 depicts schematically a plant for drying coal.

The invention will now be described in conjunction with the drawing, in which FIG. 1 depicts a plant for drying coal, such as coal of sub-bituminous or lower rank.

In FIG. 1, a run of mine coal stream is charged through a line 1 from a coal processing plant to a crusher 2 where it is crushed to a suitable size and passed through a line 3 to a hopper 4. The particular coal in hopper 4 is fed through a line 5 into a dryer 6. In dryer 6, which is of the fluid bed type, the coal moves across dryer 6 above flexibly (i.e. loosely) mounted gas distributor 7 at a rate determined by the desired residence time in dryer 6. As shown in FIG. 1, gas distributor 7 is advantageously slanted to facilitate the flow of coal from inlet 5 to outlet 18. A hot gas is produced by injecting air through a line 8 to combust coal from bin 30 in a combustor 9. A stream of hot gases line (recycle) 16 after passing through inline filter 40 is also passed into combustor 9 and the hot gases from combustor 9 are fed to dryer 6 through line 10 and through the coal moving across gas distributor 7 to dry the coal. The exhaust gas from dryer 6 is passed to a cyclone 11 where the coarsest fraction of finely divided solids is separated from the exhaust gas and recovered through a line 12 to a cooler 19. Part of the exhaust gas, which still contains smaller solids, is passed through a line 13 to a fine solids recovery section 14 where the finest divided solids, which will typically consist primarily of finely divided coal, are recovered through a line 15 with all or a portion of the finely divided coal being recycled back to the fuel bin 30 through line 29 or recombined with the product through line 32. Part of the exhaust gas containing finely divided solids line 13 is recycled to the combustor 9 through line 16 via inline filter 40. The purified exhaust gas from fine solids recovery section 14 is passed through a line 17 to be discharged to the atmosphere.

The coarser dried coal product from dryer 6 is recovered via a line 18 to a cooler 19. The dried coal moves across cooler 19 above a gas distributor 20. As in the drier, gas distributor 20 is also inclined to facilitate the flow of cooled coal. Cool gases are introduced under flexibly mounted gas distributor 20 through lines 22A and 22B and passed upwardly through the dried coal to cool the dried coal. The exhaust gas from cooler 19 is passed to a cyclone 24 where the coarser fractions of the finely divided solids are separated and recovered through a line 25 with the exhaust gas and finer fractions being passed through a line 26 to fine solids recovery section 27. The finer solids recovered in fine coal recovery section 27 are passed through line 29 to fuel bin 30 for fuel for combustor 9 or combined with product via line 32. Fuel for combustor 9 can also be taken from cyclone 11 through line 31 via a pulverizer (not shown) if necessary. The purified exhaust gas from fine solids recovery section 27 is passed through line 28 to be discharged to the atmosphere. The finer dried coal product is passed from cyclone 11 through line 12 to cooler 19 which is partitioned vertically to cool both fractions separately. The coarser cooled coal emerges from cooler 19 via product exit 23 and cyclone 24 via line 25 and is recovered to line 33.

Figure 2:
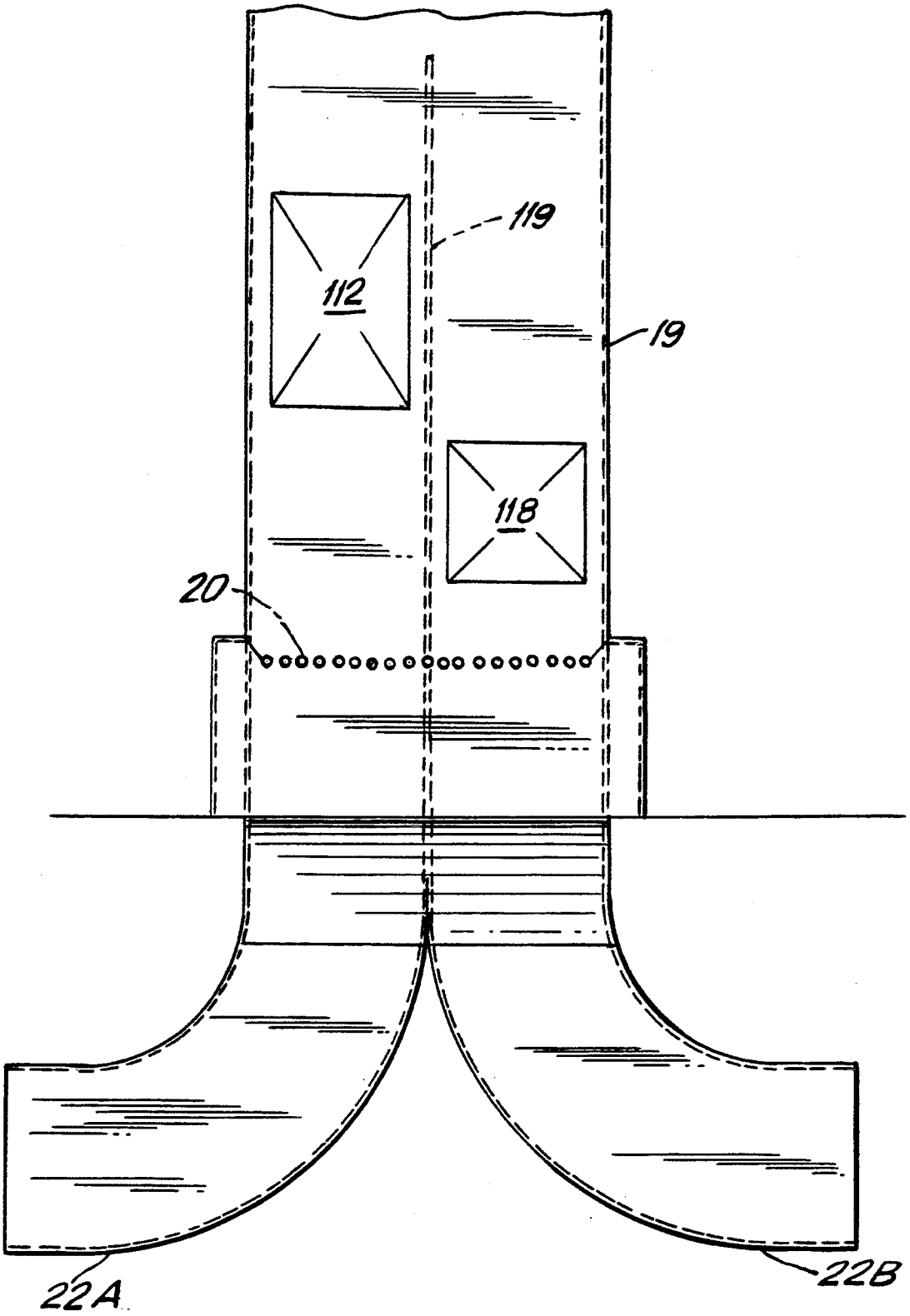
FIG. 2 depicts in elevation a fluid-bed type cooler for use with the invention.

FIG. 2 depicts in elevation cooling chamber 19 (FIG. 1) which is partitioned vertically by chamber partition 119 and is provided with deck 20 and two inlet air ducts 22A and 22B which are separated within chamber 19 (FIG. 1) by partition 119. Two coal inlets 112 and 118 are depicted, for the finer dryer cyclone underflow line 12 (FIG. 1) and the coarser dryer deck product line 18 (FIG. 1).

Figure 3:
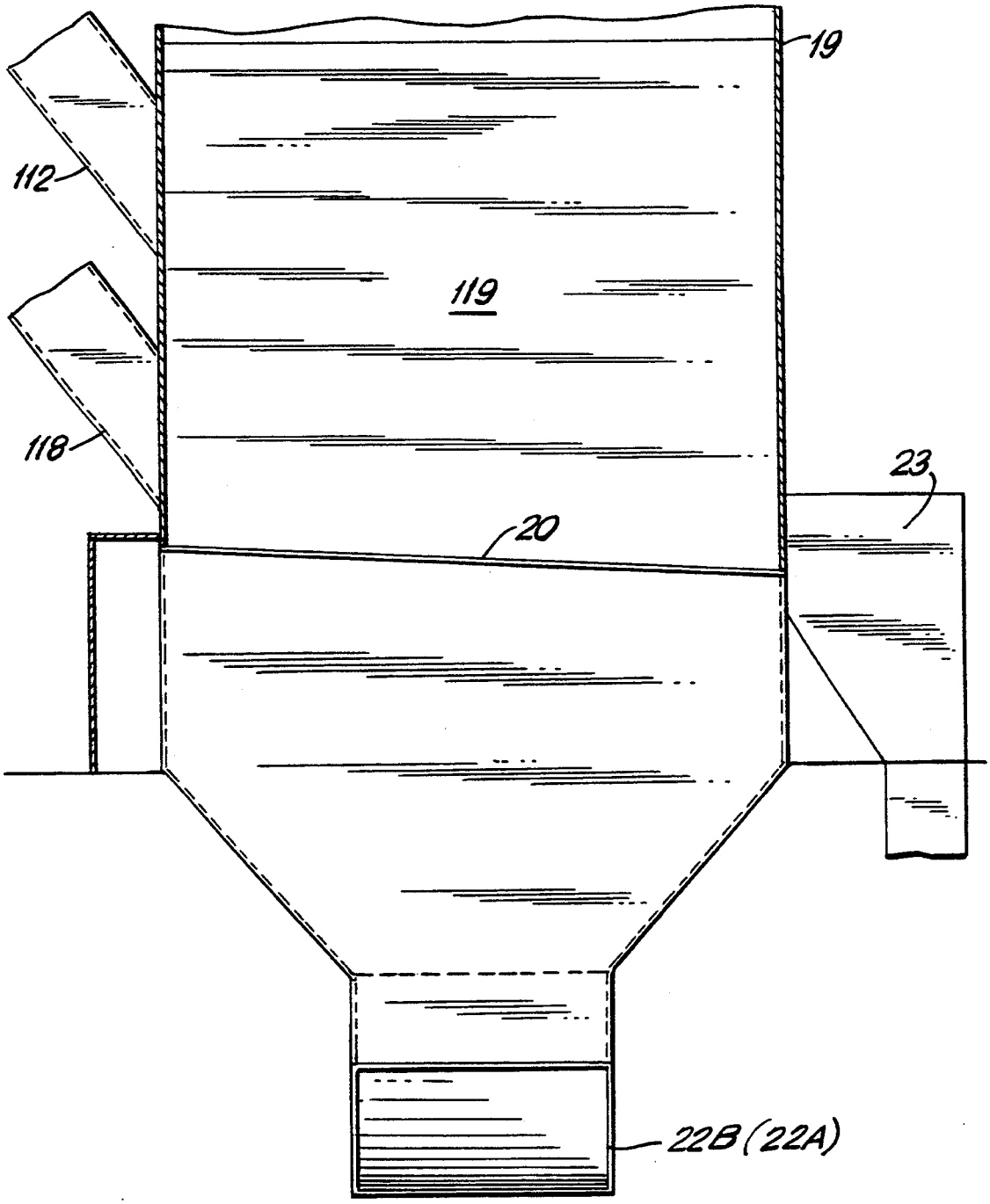
FIG. 3 depicts in elevation the fluid-bed type cooler as depicted in FIG. 2 in a view rotated 90° from that of FIG. 2.

FIG. 3 depicts at 90° from FIG. 2 removed in plan, an elevation of cooling chamber 19 (FIG. 2) wherein fine feed inlet 112, coarse feed inlet 118 and product exit 23 are shown. Partition 119 is shown as extending vertically through chamber 19 (FIG. 2) below the deck 20 (FIG. 2) such that air flows from the two inlet ducts 22A and 22B are kept separate. Underflow from cooler cyclone 19 (FIG. 2) is combined in the product.

Figure 4:
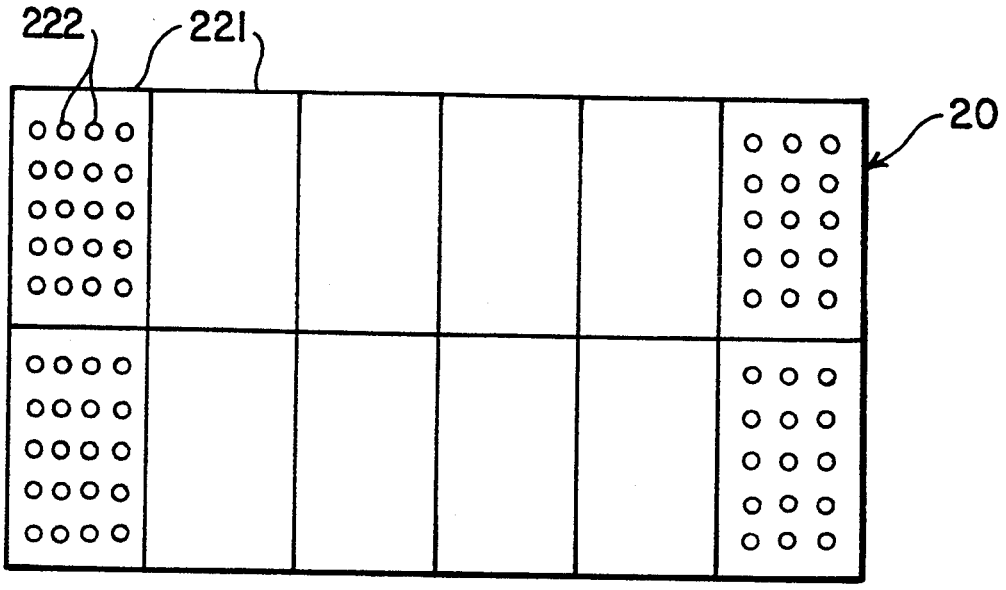
FIG. 4 is cross section along line 4—4 in FIG. 3 and illustrates a gas distributor in accordance with the present invention.

FIG. 4 is a cross sectioned view of the fluid bed cooler taken along the line 4—4 in FIG. 3. Gas distributor 20 consists of a plurality of thin plates 221 having multiple perforations 222. Thin plates 221 are flexibly mounted as supports, net shown, so that the interaction of the fluidizing gas, thin plates 221 and the fluidized solids causes thin plates 221 to flex and thus to become self-cleaning. Most advantageously, thin plates 221 are floatably mounted. Although FIG. 4 illustrates the use of a plurality of thin plates, a single plate could be employed but the benefits of ease and cost of replacement are not fully realized.

Figure 5:
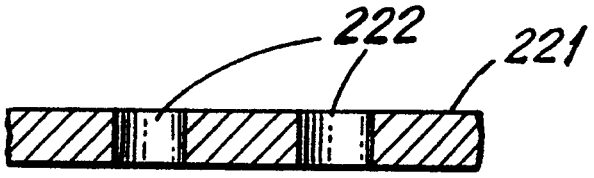
FIG. 5 illustrates a partial cross-section of a gas distributor plate in accordance with the present invention.

FIG. 5 is a partial cross section through a thin plate 221 having multiple perforations 222. The openings of perforation 222 are correlated with the thickness of thin plate 221 so that upon being flexed thin plate 221 becomes self-cleaning. Advantageously, the thickness of plate 221 is no greater than the smallest opening of the perforations 222 thereby eliminating material buildup in the holes. The thickness of plate 221 must be sufficiently thick to provide support for the static bed of processed solids but must not be so thick as to become non-flexible. Furthermore, the thickness of the plate should be sufficiently thin to resist distortion from thermal cycling. The number of perforations per plate is selected so that the plate has between about 2% and about 25% open area, advantageously between about 12.5% and about 22% open area. For example, when cooling dried coal in two chambers as described hereinbefore, the plates for the chamber for cooling the larger particles have an open area between about 10% and about 12% while the plates for in the chamber for cooling the smaller particles have an open area between about 2% and about 5%.

Thin plates 221 can be made of a wide range of materials depending upon the temperature employed, the corrosive nature of the environment within the fluid bed reactor and the abrasiveness of the fluidized solids.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A fluidized bed reactor, comprising:
a housing defining an enclosed reactor space;
a gas distribution plate having a plate thickness and a plurality of openings extending therethrough, each said opening having an effective diameter which is at least as great as said plate thickness, wherein said gas distribution plate separates said housing into upper and lower chambers;
at least one solids inlet and at least one solids outlet through said housing in said upper chamber above said gas distribution plate;
at least one fluidizing medium inlet through said housing in said lower chamber below said gas distribution plate;
at least one fluidizing medium outlet through said housing in said upper chamber above said gas distribution plate; and
a fluidizing medium supply system.

2. A fluidized bed reactor, as claimed in claim 1, wherein:
said gas distribution plate is floatably interconnected with said housing.

3. A fluidized bed reactor, as claimed in claim 1, wherein:
said gas distribution plate is inclined within said housing to facilitate a flow of solids from said at least one solids inlet to said at least one solids outlet.

4. A fluidized bed reactor, as claimed in claim 1, wherein:
said gas distribution plate is divided into at least first and second sections each having a portion of said plurality of openings, said openings in said first section providing a first open area through said first section and said openings in said second section providing a second open area through said second section which is of a different magnitude than said first open area.

5. A fluidized bed reactor, as claimed in claim 4, wherein:
said first open area ranges from about 10% to about 12% and said second open area ranges from about 2% to about 5%.

6. A fluidized bed reactor, as claimed in claim 1, wherein:
said plurality of openings provide an open area in said gas distribution plate ranging from about 2% to about 25%.

7. A fluidized bed reactor, as claimed in claim 1, wherein:
said plurality of openings provide an open area in said gas distribution plate ranging from about 12.5% to about 22%.

8. A fluidized bed reactor, comprising:
a housing defining an enclosed reactor space;
a gas distribution plate having a plate thickness and a plurality of openings extending therethrough, each said opening having an effective diameter which is at least as great as said plate thickness, wherein said gas distribution plate separates said housing into upper and lower chambers and wherein said gas distribution plate is floatably interconnected with said housing;

at least one solids inlet and at least one solids outlet through said housing in said upper chamber above said gas distribution plate;

at least one fluidizing medium inlet through said housing in said lower chamber below said gas distribution plate;

at least one fluidizing medium outlet through said housing in said upper chamber above said gas distribution plate; and a fluidizing medium supply system.

9. A fluidized bed reactor, as claimed in claim 8, wherein:

said gas distribution plate is inclined within said housing to facilitate a flow of solids from said at least one solids inlet to said at least one solids outlet.

* * * * *